United States Patent [19]

Graveman et al.

[11] Patent Number: 4,720,051

[45] Date of Patent: Jan. 19, 1988

[54] HAMMER-TYPE SHREDDER WITH AIR DEFLECTOR

[75] Inventors: Donald F. Graveman, St. Charles; Sven B. Strom, St. Louis, both of Mo.

[73] Assignee: American Pulverizer Company, St. Louis, Mo.

[21] Appl. No.: 809,485

[22] Filed: Dec. 16, 1985

[51] Int. Cl.[4] ..... B02C 13/282

[52] U.S. Cl. ..... 241/186.3; 241/189 R

[58] Field of Search ..... 241/186.2, 186.3, 189 A, 241/189 R, 188 R

[56] References Cited

U.S. PATENT DOCUMENTS

| | | | |
|---|---|---|---|
| 1,872,233 | 8/1932 | Borton | 241/189 R |
| 2,463,843 | 3/1949 | Wright | 241/189 RX |
| 4,373,678 | 2/1983 | Reitter | 241/189 R |

*Primary Examiner*—Timothy V. Eley

*Attorney, Agent, or Firm*—Gravely, Lieder & Woodruff

[57] ABSTRACT

A shredding machine has a housing provided with an upwardly presented inlet, and in addition a rotor which revolves within the housing over an arcuate grate which is also in the housing. The rotor includes hammers, the tips of which describe a hammer circle that passes close to the arcuate grate. The hammers generate considerable windage as the rotor revolves, and to prevent this windage from being directed upwardly out of the inlet and thereby interfering with the flow of light-weight feed materials into and through the inlet, a deflector is mounted in the housing over the hammer circle, generally along that portion of the hammer circle that leads up to the top of the circle. The deflector directs the windage generally laterally across the inlet instead of upwardly out of it, and indeed causes much of the air to be drawn around and to a large measure discharged through the grate. As a result even light weight feed materials fall easily into the hammers.

22 Claims, 2 Drawing Figures

HAMMER-TYPE SHREDDER WITH AIR DEFLECTOR

BACKGROUND OF THE INVENTION

This invention relates to shredding machines and more particularly to a machine capable of accommodating lightweight feed materials.

One type of machine commonly used to shred practically any type of refuse, from metal scrap to waste paper, employs a rapidly revolving rotor which carries swing hammers past a grate. Actually, the grate is mounted at the bottom of a housing in which the rotor revolves, and this housing has at its top a large opening through which the refuse is introduced into the machine. The refuse falls into the circular path described by the hammers, and the hammers carry the refuse across the grate where it is shredded. The shredded refuse drops through the openings in the grate to fall out of the machine in a highly condensed form.

Machines of the foregoing character function quite well with heavy or dense refuse such as metal and most wood scrap. However, lightweight refuse,such as loose newspaper and corrugated paperboard, tends to be air-supported or bouyed, or at least cannot be fed evenly into the machine.

The problem resides in the windage developed by the rotor within the confines of the housing. In this regard, the machine acts like a giant fan, drawing air into the housing along one side of the inlet and through the grate and discharging it with considerable velocity through the inlet. Light materials, such as corrugated paperboard, tend to remain suspended in this airstream and indeed accumulate in the airstream above the rotor until the weight of the accumulated materials is enough to overcome the suspension effect, at which time the entire mass of accumulated material drops downwardly into the revolving hammers on the rotor. This overloads the rotor, causing it to bog down and perhaps stall. Thus, the windage created by a conventional shredding machine prevents the machine from accepting lightweight feed materials uniformly, so when used to reduce such materials, the machine does not operate evenly, but instead in surges. This in turn places undue stress on the machine, consumes more energy, and results in less efficient operation.

The foregoing problem could perhaps be eliminated by reducing the size of the inlet and locating it entirely to that side of the rotor at which the hammers pass over top center and descend. This, however, reduces the capacity of the machine and as a result the machine will not accept large items of refuse.

SUMMARY OF THE INVENTION

One of the principal objects of the present invention is to provide a shredding machine which will accept lightweight feed materials uniformly so the machine operates evenly and not in surges. Another object is to provide a machine of the type stated which directs windage from the rotor laterally at the inlet for the machine, so that an airstream is not directed upwardly through the inlet. A further object is to provide a machine of the type stated which has a large inlet capacity essentially the same as that of a conventional machine of equivalent rotor size. An additional object is to provide a machine of the type stated which discharges windage downwardly through its grate instead upwardly through its inlet. These and other objects and advantages will become apparent hereinafter.

DESCRIPTION OF THE DRAWINGS

In the accompanying drawings which form part of the specification and wherein like numerals and letters refer to like parts wherever they occur

DETAILED DESCRIPTION

Figure 1:
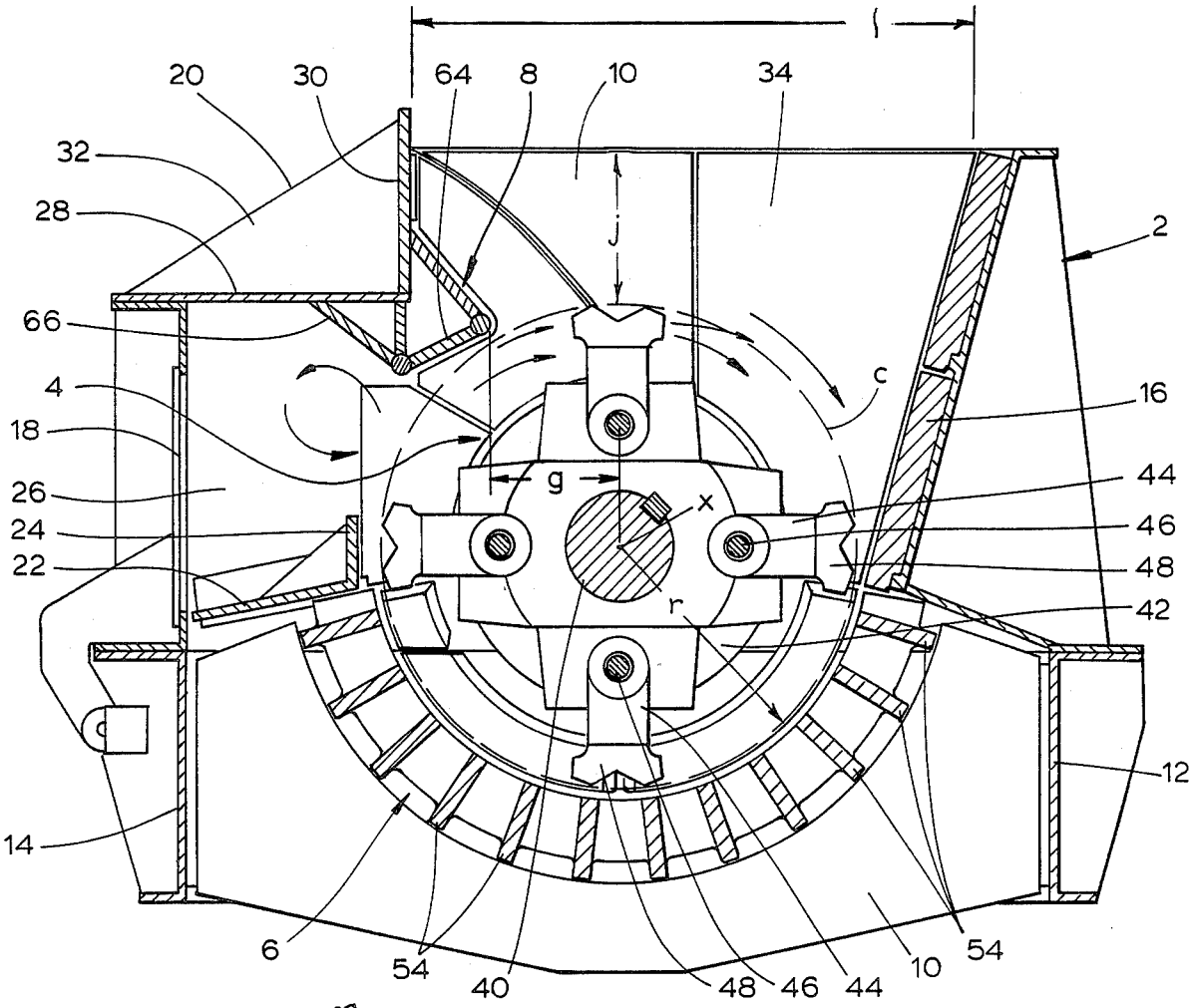
FIG. 1 is a sectional view of a shredding machine constructed in accordance with and embodying the present invention, the section being taken along a plane that passes through the machine perpendicular to the axis of rotation for its rotor.
Figure 2:
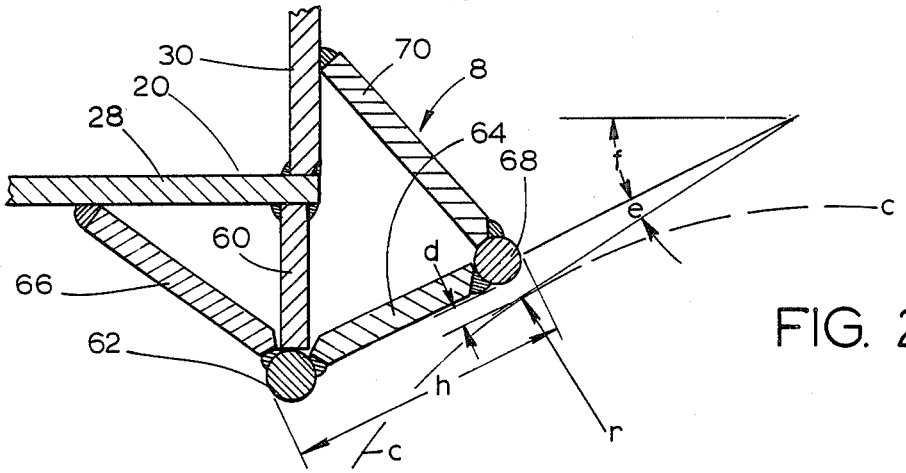
FIG. 2 is an enlarged sectional view of the windage deflector for the machine.

Referring now to the drawings, a shredding machine A is designed to accept feed materials, such as refuse, and to thereby reduce such feed materials to a smaller and more condensed form. The feed materials enter the top of the machine A under their own weight and after being shredded fall from the bottom of the machine. Where refuse is the feed material, it may include relatively dense materials, such as metals, wood, glass, and plastics, as well as lightweight materials, such as paper and corrugated paperboard. The machine A includes a housing 2, a rotor 4 that revolves within the housing 2 about an axis x, a grate 6 that is located within the housing 2 beneath the rotor 2, and a windage deflector 8 also located in the housing generally above the rotor 4, but offset from the axis x.

Considering the housing 2 first, it includes spaced apart end walls 10 which are parallel to each other and lower front and back walls 12 and 14 which extend between the lower portions of the end walls 10 in the region of the grate 6. The side walls 10 are lined with a wear resistant substance such as manganese steel, and within the region of the grate 6, these liners have grooves into which the ends of the grate 6 fit so that the grate 6 extends between the two side walls 10 and is supported by those side walls 10. Above the front wall 12, the front of the housing 2 is closed by a breaker plate 16 which likewise extends between the two end walls 10. The breaker plate 16 leads downwardly from the top of the housing 2 to the upper end of the grate 6, it being inclined somewhat with respect to the vertical so that any refuse which comes against it will slide downwardly along it toward the rotor 4. The breaker plate 16 likewise includes wear resistance liners presented toward the interior of the housing 2. At the back of the housing 2 an upper back wall 18 extends directly upwardly from the lower back wall 14, and near the top of the housing 2 it is joined to a rear cover 20 which projects toward the breaker plate 16 and lies over a small portion of the rotor 4. Both the upper back wall 18 and the cover 20 extend completely across the housing 2 from one end wall 10 to the other.

While one end of the grate 6 lies beneath and indeed aligns with the breaker plate 16, the opposite end is spaced inwardly from the upper back wall 18, and extended between the two is a trap floor 22 which is inclined slightly downwardly toward the back wall 18. The floor 22 which has a lip 24 which projects upwardly toward the rear cover 20 and forms the bottom of a trap chamber 26 to which tramp metal and other objects too large to pass through the grate 6 are diverted.

The cover 20 includes a horizontal plate 28 which is spaced from the trap floor 22, a vertical or upright plate 30 that is located opposite to the upper portion of the breaker plate 16 and gussets 32 which extend between the horizontal and vertical plate 28 and 30 at the outside of the cover 20. That portion of the housing 2 which lies between the vertical plate 30 at the back of the housing 2 and the breaker plate 16 at the front of the housing 2 is completely open and constitutes an inlet 34 through which feed material is introduced into the housing 2 to be reduced in size by the rotor 4. Indeed, the breaker plate 16 and the vertical plate 30 form the front and back surfaces, respectively, of the inlet. The end walls 10 extend between the breaker plate 16 and the vertical plate 30 and form the ends of the inlet 34. By reason of the inclination of the breaker plate 16, the inlet 34 is larger at the top of the housing 2 than it is immediately above the rotor 4.

The rotor 4 includes a shaft 40 which extends concentric to the axis x completely through the housings 2 from one end wall 10 to the other, and beyond the two end walls 10 it is supported in pillow blocks (not shown) which are in turn bolted to the housing 2. At one of its ends the shaft 40 is connected to an electric motor which furnishes the power for turning the rotor 4. Moreover, the shaft 40 at either or both of its ends may be fitted with a flywheel.

Within the space between the two end walls 10 the shaft 40 is fitted with a succession of disks 42 which outwardly from the shaft 40 are spaced apart to provide pockets from which shredder hammers 44 project, these hammers 44 being retained on hammer shafts 46 which extend axially through the disks 42. The hammers 44, which are likewise formed from a wear resistant material such as manganese steel, project radially beyond the disks 42 and at their outer ends have enlarged heads 48 which engage material introduced into the machine A through the inlet 34. The hammers 44, by reason of their pivotal connections to the disks 42 at the hammer shafts 44, are free to swing backwardly and forwardly in the pockets from which they project, but when the shaft 40 turns, the centrifugal force exerted on the hammers 46 causes them to stand out and assume a radial orientation with respect to the axis x. When so diposed, the outer edges or tips of the heads 48 on the hammers 44 describe a hammer circle c. Since the hammers 46 are free to swing on the hammer shafts 44, they may move backwardly upon encountering an object that offers substantial resistance, thus preserving the hammers 46 and the rest of the rotor 4 as well, from damage where an over sized or unshredable object is introduced through the inlet 34.

The grate 6 comprises a secession of grate bars 54 arranged in an arc between the lower end of breaker plate 16 and the trap floor 22. Along this arc, which is concentric to the axis x, the inner edges of the bars 54, that is the faces which are presented toward the rotor 4, are spaced between about ¾ and 2 inches from the hammer circle c. Actually the bars 54 are joined together into panels, with each panel consisting of several bars, and the ends of the panels fit into the arcuate grooves in the liners of the end walls 10, thus retaining the entire grate 6 in place within the housing 2.

As the rotor 4 revolves, its hammers 44 engage refuse that is introduced into the housing 2 through the inlet 34. The hammers 44 upon striking this refuse commence to shred it and further carry it over the grate 6 where the shredding continues. After a short distance the refuse is reduced to a size small enough to fall through the spaces between the bars 54 of the grate 6, and that it does. The bottom of the housing 2 is completely open, so the shredded refuse falls through it and out of the machine A.

The revolving rotor 4 acts like a giant fan and thus produces a considerable amount of windage. Without the windage deflector 8, the resulting airstream would discharge directly upwardly through the inlet 34, with its direction being generally parallel to the end walls 10 and the vertical plate 30 of the rear cover 20. Because the upwardly directed airstream would occupy substantially the entire inlet 34, any lightweight refuse would tend to be blown out of the inlet 34 or at least suspended in the inlet 34 until it acquired enough mass to overcome the effect of the airstream. The deflector 8 directs the airstream somewhat laterally, and in effect causes it to more or less follow the hammers 44 around the hammer circle c, so that the airstream for the most part discharges downwardly through the grate 6. Thus, lightweight refuse, instead of remaining suspended in the inlet 34, is actually drawn into the inlet 34 and into the revolving hammers 44.

The deflector 8 which is mounted entirely on the rear cover 20, includes a spacer 60 which projects downwardly from the horizontal plate 28 of the cover 20 immediately below the intersection of the horizontal and vertical plates 28 and 30, it being welded to the horizontal plate 28. Along the lower edge of spacer 60 is a circular connecting rod 62 to which front and rear deflector plates 64 and 66, both of which are flat, are attached.

The rear deflector plate 66 along its lower edge is welded to the rod 62, and from that point of attachment extends obliquely upwardly toward the horizontal plate 28 to which it is welded along its upper edge, the arrangement being such that both the inclined rear deflector plate 66 and the horizontal plate 28 of the cover 20 form the roof of the trap chamber 26. Indeed, the rear deflector plate 66 is positioned such with respect to the rotor 4, that oversize objects which are carried over the grate 6 by the hammers 44, will, upon being hurled upwardly by those hammers 44, most likely come against the rear deflector plate 66, to be directed by that plate into the trap chamber 26. The objects accumulate on the floor 22 of the chamber 26.

The front deflector plate 64 is likewise welded along one of its edges to the rod 62, but it projects in the opposite direction, that is toward the breaker plate 16 on the opposite side of the housing 2. The front deflector plate 64 is likewise inclined upwardly away from the connector rod 62, with its inclination being such that it converges toward the hammer circle c. Nevertheless, the plate 64 is in its entirety offset laterally from the axis x, it being generally between the axis x and that side of the hammer circle c which is closest to the upper back wall 18. The opposite end of the front deflector plate 64 is welded to another connecting rod 68 to which the lower edge of a reinforcing plate 70 is also welded, the latter extending upwardly at an oblique angle to the vertical plate 30 of the cover 20 to which it is welded along its upper edge. Thus, the reinforcing plate 70 together with the spacer plate 60 and the rear deflector plate 66 as well, serve to locate the front deflector plate 64 in a fixed and determined position with respect to the nearby hammer circle c.

Each rod 62 and 68 is composed of several axially aligned segments, with each segment being about 12 to 18 inches long. Thus, if one rod segment breaks loose it will merely be carried around by the rotor and deflected into the trap chamber 26.

In this fixed and determined position the connector rods 62 and 68 at each end of the front deflector plate 64 form part of the plate 64 inasmuch as they are merely extensions of the plate 64, particularly the front rod 68. The clearance d between the hammer circle c and the front end of the deflector plate 64 or the connector rod 68 along the front edge of that plate should be between about ¼ and ⅞ inches and should preferably be as small as possible, given the tolerances in hammer construction. The angle e between the plate 64 and a tangent to the hammer circle c at a point on that circle located immediately inwardly from the connector rod 68 should range between 3° and 6° and should preferably be 4°, while the angle f between the plate 64 and the horizontal should be between 20° and 25° and preferably 23°. The lower connector rod 62 should be offset inwardly from the farthest lateral extent of the hammer circle c, while the upper connector rod 68 should be offset a distance g in the opposite direction from the axis x. This places the front deflector plate 64 over that quadrant of the rotor 4 that is presented toward the rear cover 20. Indeed, the lateral offset g of the plate 64 should range between 55% and 65% of the radius r of the hammer circle c. Moreover, the lower surface of the front plate 64, which is actually the deflecting surface of that plate, should be in its entirety below the top of the hammer circle c. On the other hand, the length 1 of the inlet 34 should be substantially greater than the radius r of the hammer circle c and should even exceed the diameter of the hammer circle c. The length h of the front plate 64 should range between 40% and 45% of the radius r of the hammer circle c. Finally, the distance j from the top of the inlet 34 to the top of the hammer circle c should be no less than 65% of the radius r.

In the operation of the shredding machine A, the rotor 4 revolves with its hammers 44 passing generally upwardly by the deflector 8, thence toward the breaker plate 16 and then along the grate 6. The hammers 44 create a considerable amount of windage or in other words generate an airstream which, were it not for the windage deflector 8, would blow directly out of the inlet 34 and keep lightweight feed materials suspended within the inlet 34, at least until enough accumulated to overcome the suspension effect. The front deflector plate 64 directs this airstream generally laterally across the top of the rotor 4 and toward the breaker plate 16. Indeed, with this deflection the air is to a large measure carried around by the hammers 44 and discharged through the grate 6 at the bottom of the housing 2. Some of the windage however, is deflected outwardly by the rear deflector plate 66, and within the trap chamber 26 is turned completely around and then directed toward the rotor 4 to also be carried around by the hammers 44 and likewise discharged through the grate 6. Thus, instead of generating an updraft, the machine A produces a downdraft. As a consequence, even lightweight refuse that is introduced into the machine A at the inlet 34 of its housing 2 is drawn into the rotor 4 and reduced in size as the rotor 4 engages such refuse and draws it over the grate 6. In this regard, the hammers 44 bring the refuse into the converging space between the breaker plate 16 and the hammer circle c and in so doing the refuse is reduced somewhat. Thereafter, the hammers 44 carry the refuse over the bars 54 of the grate 6 where it is reduced still further. The refuse is so shredded until it is small enough to pass through the spaces between the grate bars 54, which it does, thereafter falling out of the open bottom of the housing 2 and free of the machine A.

Thus, the machine A immediately accepts and reduces refuse that is introduced into its inlet 34, even when that refuse is light in weight or of low density, this being accomplished without reducing the size of the inlet 34 or offsetting the inlet 34 to one side of the rotor 4. Assuming that the refuse is fed to the inlet 34 uniformly, the machine A operates evenly without surging. In other words, lightweight refuse does not remain suspended in the inlet 34 and then drop downwardly as a mass to produce a substantial loading of the machine. Yet the inlet 34 remains full size for receiving large refuse objects.

Any tramp metal or other objects which are too large to pass through the grate 6 are hurled upwardly at the end of the grate 6 and into the trap chamber 26, and in entering the chamber 26 most such objects impinge against the rear deflector plate 66 which directs them laterally toward the upper rear wall 18. These objects accumulate on the floor 22 of the trap chamber 26, and are kept from the hammers 46 by the lip 24 at the end of the floor 22.

This invention is intended to cover all changes and modifications of the example of the invention herein chosen for purposes of the disclosure which do not constitute departures from the spirit and scope of the invention.

What is claimed is:

1. A machine for shredding material, said machine comprising: a housing having an upwardly presented inlet into which the material to be shredded is introduced, the housing also having spaced apart end walls, a breaker plate, and an upright wall which surround the inlet; a rotor mounted in the housing with its axis of rotation passing through the end walls and being generally parallel to the breaker plate and upright wall, with the breaker plate being to one side of the axis and the upright wall to the other side of the axis, the rotor having hammers, the tips of which describe a hammer circle as the rotor revolves, the direction of rotation being such that the hammers move upwardly toward that region of the inlet that is located along the upright wall and thence, after coming over the top of the hammer circle, move toward the breaker plate, the diameter of the hammer circle being no larger than the length of the inlet measured from the upright wall to the breaker plate; an arcuate grate located in the housing generally below and generally concentric to the hammer circle, with one end of the grate being at and aligned with the lower end of the breaker plate, the grate having openings through which shredded refuse will pass; and a deflector mounted on the housing to direct windage generated by the revolving hammers generally laterally through the inlet instead of upwardly out of the inlet, the deflector including a first deflector plate which projects over that portion of the hammer circle that leads up to the top of the hammer circle and further projects laterally beyond the upright all, but is nevertheless offset in its entirey to that side of the axis of rotation on which the upright wall is located, the spacing between the first deflector plate and the hammer circle where the first deflector plate is closest to the hammer circle being no greater than about ⅞ inches.

2. A machine according to claim 1 wherein the deflector plate converges with respect to the hammer circle in the direction of hammer movement along that circle.

3. A machine according to claim 2 wherein the deflector plate is further inclined upwardly in the direction of movement of the hammers along the hammer circle.

4. A machine according to claim 3 wherein the lower surface of the deflector plate is in its entirety located below the top of the hammer circle.

5. A machine according to claim 3 wherein the housing encloses a trap chamber located to that side of the rotor at which the deflector is located; and wherein the deflector further comprises a second deflector plate which faces the trap chamber toward that side of the rotor on which the deflector is located, the second deflector plate being oriented such that objects, which because of their size are carried over the grate, instead of passing through it, and are hurled upwardly, strike the second plate and are thereby deflected into the trap chamber.

6. A machine according to claim 1 wherein the angle between the first deflector plate and the horizontal is between about 20° and 25°.

7. A machine for shredding material, said machine comprising: a housing having an upwardly presented inlet into which the material to be shredded is introduced, the housing also having spaced apart end walls, a breaker plate, and an upright wall which surround the inlet; a rotor mounted in the housing with its axis of rotation passing through the end walls and being generally parallel to the breaker plate and upright wall, with the breaker plate being to one side of the axis and the upright wall to the other side of the axis, the rotor having hammers, the tips of which describe a hammer circle as the rotor revolves, the direction of rotation being such that the hammers move upwardly toward the region of the inlet that is located along the upright wall and thence, after coming over the top of the hammer circle, move toward the breaker plate, the diameter of the hammer circle being no larger than the length of the inlet measured from the upright wall to the breaker plate; an arcuate grate located in the housng generally below and generally concentric to the hammer circle, with one end of the grate being at and aligned with the lower end of the breaker plate, the grate having openings through which shredded refuse will pass; and a deflector mounted on the housing to direct windage generated by the revolving hammers generally laterally through the inlet instead of upwardly out of the inlet, the deflector including a deflecting surface which extends over and close to that portion of the hammer circle that leads up to the top of the hammer circle, the deflecting surface further projecting laterally beyond the upright wall, but nevertheless being offset in its entirety to that side of the axis of rotation on which the upright wall is located, the deflecting surface converging toward the hammer circle in the directon of hammer movement along that portion of the hammer circle that is closest to the deflecting surface.

8. A machine according to claim 7 wherein the spacing between the deflecting surface and the hammer circle where the deflecting surface is closest to the hammer circle does not exceed about $\frac{7}{8}$ inches.

9. A machine according to claim 7 wherein the angle between the deflecting surface and the horizontal is between about 20° and 25°.

10. A shredding machine comprising: a housing having an upwardly opening inlet into which material that is to be shredded is introduced, the inlet being defined in part by spaced apart front and back surfaces; a rotor located generally within the housing and having within the housing hammers, which when the rotor revolves move generally upwardly toward that region of the inlet that is along the back surface of the inlet and thence toward the front surface of the inlet, where by the hammers will engage material introduced into the inlet to shred that material, the tips of the hammers, as the hammers revolve, describing a hammer circle, the radius of which is substantially smaller than the length of the inlet measured between its front and back surfaces, a grate located in the housing below the hammer circle and containing openings through which the shredded material falls; and a deflector located generally within the housing along the back surface of the inlet and having a first deflecting surface that is presented downwardly toward and in close proximity to the hammer circle and having a leading edge, the first deflecting surface in the region of its leading edge being no more than about $\frac{7}{8}$" from the hammer circle as the hammers pass by that surface, the first deflecting surface also converging with respect to the hammer circle as the hammers approach said deflecting surface and otherwise being positioned and oriented so as to cause windage which is created by the rotor to generally follow the hammers around the hammer circle instead of being discharged upwardly out of the inlet, where lightweight material will fall without impedence into the inlet to be engaged and shredded by the hammers of the rotor.

11. A machine according to claim 10 wherein the deflector is in its entirety offset laterally from the axis of rotation for the rotor.

12. A machine according to claim 2 wherein the first deflecting surface is located in its entirety below the uppermost portion of the hammer circle.

13. A machine according to claim 12 wherein the first deflecting surface is substantially flat and the angle between the surface and a tangent to the hammer circle at the end of the surface that is closest to the hammer circle is between about 3° and 6°.

14. A machine according to claim 12 wherein the angle between the surface and the horizontal is between about 20° and 25°.

15. A machine according to claim 12 wherein the spacing between the hammer circle and the end of the first deflecting surface which is closest to the hammer circle is between $\frac{1}{4}$ and $\frac{7}{8}$ inches.

16. A machine according to claim 5 wherein the housing further contains a trap chamber and the second deflecting surface faces the trap chamber so that unshredded objects which impinge against the second surface will be directed into the trap chamber.

17. A machine according to claim 12 wherein the deflector comprises a second deflecting surface which is directed away from the rotor in the direction opposite from the first deflecting surface such that unshredded objects which are carried over the grate and hurled upwardly by the hammers will strike the second surface and be deflected laterally away from the rotor.

18. A machine according to claim 10 wherein the inlet in the housing is located between a breaker plate and an upright wall, both of which are part of the housing and form the front and back surfaces, respectively, of the inlet, with one facing the other across the inlet, the breaker plate being generally upright and aligning at its lower end with the grate, the breaker plate further being positioned such that the hammers after coming over the top of the hammer circle move toward the breaker plate; and wherein the deflector projects beyond the upright wall generally over the portion of the hammer circle that leads up to the top of that circle.

19. A machine according to claim 18 wherein the deflector includes a generally flat deflecting plate which is oriented such that it converges with respect to the hammer circle, the first deflecting surface being on the flat deflecting plate.

20. A machine according to claim 19 wherein the deflector further comprises a reinforcing plate which extends between that end of the deflector plate which is closest to the hammer circle and the upright wall.

21. A machine according to claim 10 wherein the deflector projects into the inlet generally beyond the back surface so that it is located closer to the front surface than is the back surface.

22. A machine according to claim 10 wherein the length of the inlet exceeds the diameter of the hammer circle.

* * * * *